United States Patent [19]

Musto

[11] 4,206,555

[45] Jun. 10, 1980

[54] VENTURI DISPERSING FEEDER

[75] Inventor: Richard L. Musto, Homewood, Ill.

[73] Assignee: Combustion Engineering, Inc., Windsor, Conn.

[21] Appl. No.: 29,187

[22] Filed: Apr. 12, 1979

[51] Int. Cl.[2] ..... F26B 17/10

[52] U.S. Cl. ..... 34/57 R; 34/57 A; 406/144; 406/153

[58] Field of Search ..... 406/144, 151, 153; 366/279, 325; 222/637; 34/57 R, 57 A

[56] References Cited

U.S. PATENT DOCUMENTS

| | | | |
|---|---|---|---|
| 622,429 | 4/1899 | Hazzard | 366/325 |
| 988,261 | 3/1911 | Griere | 366/325 |
| 2,157,775 | 5/1939 | Smith | 34/57 R |
| 2,903,800 | 9/1959 | Skoglund | 34/57 A |
| 3,354,555 | 11/1967 | Barr | 34/57 R |
| 3,958,342 | 5/1976 | Stephanoff | 34/57 R |
| 4,010,551 | 3/1977 | Rohde | 34/57 R |

*Primary Examiner*—Larry I. Schwartz
*Attorney, Agent, or Firm*—Arthur E. Fournier, Jr.

[57] ABSTRACT

A Venturi dispersing feeder particularly suited for utilization as part of a flash drying system, and through the operation of which wet material is introduced into a hot gas stream for purposes of effecting the rapid evaporation of the moisture in the material. The subject Venturi dispersing feeder includes a feeder body, which functions as a housing for rotor means. The latter rotor means is equipped with a multiplicity of blade means suitably mounted thereon for rotation therewith. The feeder body further has formed therein inlet means, connectable in fluid flow relation with a source of wet material and operable for feeding the wet material therethrough into the feeder body, and outlet means, connectable in fluid flow relation with a stream of hot gases and operable for discharging the wet material from the feeder body into the stream of hot gases in substantially parallel relation to the path of flow of the latter. The feeder body is suitably supported on a base. The latter base is provided with adjustment means operative for effecting adjustments in the angle of discharge of the wet material from the discharge outlet means relative to the path of flow of the stream of hot gases so that the wet material leaving the discharge outlet means can be made, through adjustments in the angle of discharge thereof, to enter the hot gas stream with the desired orientation relative thereto, i.e., in substantially parallel relation to the path of flow thereof and in coincident relation therewith.

10 Claims, 5 Drawing Figures

VENTURI DISPERSING FEEDER

BACKGROUND OF THE INVENTION

This invention relates to material feeding means and, more particularly, to a dispersing feeder for discharging wet material into a stream of hot gases in such a manner that the wet material enters the hot gas stream in substantially parallel relation to the latter's path of flow.

It has long been known in the prior art to employ a variety of different processes for purposes of effecting the removal of moisture from wet solids. One of these processes, which has proven to be particularly effective for this purpose, is that commonly referred to by those in the art as flash drying. Briefly stated, flash drying is a process for effecting the instantaneous removal of moisture from various products. In accord therewith, the wet material is carried in a high velocity. air stream and is then introduced to extremely high temperatures, whereby a complete drying of the wet material occurs almost instantaneously, i.e., in only six to ten seconds.

Basically, there are four factors that influence the rate of evaporation that takes place during the flash drying process. These are: moisture dispersion, temperature differential, agitation and particle size. As concerns moisture dispersion, in order to achieve the rapid drying desired during the flash drying process, it is important that there exists maximum moisture surface exposure of the wet material. Filter cakes, for example, have very unfavorable drying characteristics. Regarding the matter of temperature differential, it is desirable for rapid drying, as well as high thermal efficiency that high temperatures, on the order of 1300° F., be present. Such high temperatures are possible due to the extremely rapid drying action that occurs with the result that the product temperature never exceeds the wet bulb temperature until all surface moisture is removed. The third factor mentioned above is that of agitation. With respect thereto, maximum agitation or turbulence is also known to produce rapid drying. In the flash drying process, such maximum agitation or turbulence is achieved through the utilization of a disintegration mill and high gas velocities to which the wet material is subjected. Namely, the combination of the action of the disintegration mill and the high gas velocities is operative to effect a continuous sweeping away of the vapor film from the moisture particles, thereby providing moisture removal, which is practically instantaneous. Finally, there is the matter of product size. With reference thereto, since the internal moisture in a particle must reach the surface thereof by capillary action, it should be thus readily apparent that the smaller the particle, the more rapid will be the removal of moisture therefrom.

Inasmuch as frequently a need exists to effect the disintegration of the material that is to be dried, it is quite common to find a cage mill being utilized for this purpose. In addition to effecting the disintegration of the wet material, the cage mill also is employed to effect the dispersion of the wet feed in the hot gas for purposes of achieving rapid evaporation. From a structural standpoint, the cage mill resembles a centrifugal fan in which the rotor has been replaced with either a bar studded spider or a series of concentric squirrel cages. Note is taken here of the fact that both the wet feed, i.e., the material to be dried, and the hot gas utilized in the drying process flow through the cage mill.

Unfortunately, there are two major disadvantages associated with the employment of the aforesaid cage mill. The first of these is the fact that feed material tends to build up on the interior surfaces or hang up in the corners and crevices of the cage mill. Consequently, if this material is combustible, it will burn. Or, if it is heat sensitive, it will degrade and contaminate the product sought to be provided from the flash drying process. The second disadvantage resides in the fact that since the cage mill is constructed of steel, it is subject to heat damage. Accordingly, the temperature of the hot gas being provided to the cage mill from the air heater must be limited.

A need has thus been evidenced for a feeder that would be free of the disadvantages passed possessed by a cage mill as enumerated above. Namely, a need has been shown to exist for a feeder that would function to introduce wet material into a hot gas stream flowing in a conduit in such a manner that any agglomerates present in the wet material, when the latter enters the feeder, are disintegrated within the feeder such that the wet material is discharged from the feeder at a high velocity in a non-agglomerated form thereby permitting rapid flash drying to take place in the presence of the hot gas. It is important that the wet material be discharged into the conduit in such a manner as to not impact on the side wall of the conduit. Otherwise, material build up could occur on the conduit side walls with the same adverse effects as those from which the cage mill suffers. Namely, it is important that the relationship of the angle of discharge of the wet material from the feeder relative to the path of flow of the hot gas stream in the conduit be such that the wet material enters the hot gas stream substantially parallel thereto and coincident therewith.

In accord with the present invention, it has been found that maximum mixing of the wet feed and hot gas occurs when the wet feed is discharged in such a manner as to enter the hot gas stream substantially parallel thereto and coincident therewith. Moreover, in accord with the present invention, a Venturi dispersing feeder is provided, which is advantageously characterized as follows: No hot gases flow through the subject Venturi dispersing feeder. Hence, no burning of material therein can take place. Moreover, since the hot gases do not pass through the subject Venturi dispersing feeder, no limit is imposed thereby on the temperature of the inlet gas received as the feeder from the air heater. Also, the subject Venturi dispersing feeder has been found to be much more effective in the disintegration of agglomerates present in the wet material as compared, for instance, to a cage mill. In addition, because the wet feed is discharged from the Venturi dispersing feeder so that it enters the conduit vertically and parallel to the path of flow of the hot gas stream therein, the wet material makes no contact with the hot surfaces of the conduit.

It is, therefore, an object of the present invention to provide a dispersing feeder for discharging wet feed, i.e., material to be dried, into a hot gas stream.

It is another object of the present invention to provide such a dispersing feeder, which is particularly suited for use as one of the operating components in a flash drying system.

It is still another object of the present invention to provide such a dispersing feeder, which is operative to discharge the wet material therefrom in such a manner that the latter enters the hot gas stream substantially parallel thereto.

A further object of the present invention is to provide such a dispersing feeder, which embodies adjustment means operative to effect adjustments in the angle of discharge of the wet material therefrom to compensate for variations in material feed rates and/or gas flow rates.

A still further object of the present invention is to provide such a dispersing feeder embodying adjustment means operative to enable the angle of discharge of the wet material from the feeder to be set relative to the center line of the conduit through which the hot gas stream flows, whereby the point of entry of the wet material into the hot gas stream can be selected so that the wet material will not impact against the conduit side wall, but will become comixed with the gas stream.

Yet another object of the present invention is to provide such a dispersing feeder, which is characterized in the fact that there is no flow of the hot gas stream therethrough.

Yet still another object of the present invention is to provide such a dispersing feeder, which is particularly effective in accomplishing the disintegration of the agglomerates embodied in the wet material entering the feeder.

Yet still a further object is to provide such a dispersing feeder, which is relatively economical to manufacture, readily capable of being incorporated in flash drying systems, and which is capable of providing effective and reliable operation.

SUMMARY OF THE INVENTION

In accordance with the present invention, there is provided a Venturi dispersing feeder that is particularly suited for utilization as part of a flash drying system. The function of the Venturi dispersing feeder in such a flash drying system is to effect the introduction of wet material into a hot gas stream for purposes of accomplishing the rapid evaporation of the moisture, which is found contained in the material. The subject Venturi dispersing feeder includes a body that forms the housing for a rotor shaft. The latter rotor shaft has a multiplicity of spider members fixedly attached thereto for rotation therewith. Each of the spider members preferably terminates in a replaceable blade suitable mounted thereto. Furthermore, each of the blades is preferably mounted on a corresponding one of the spider members so as to bear a 30° angle relative to the rotor shaft and so that each succeeding one of the blades bears a 150° angle to the rotor shaft. The feeder body has formed therein an inlet, connectable to a source of wet feed, i.e., material to be dried, and through which the wet material enters the feeder. In addition, the feeder body has also formed therein an outlet, capable of being cooperatively associated with a conduit through which a hot gas stream flows, and operative to enable wet material to be discharged from the feeder into the hot gas stream flowing into the conduit. Both the inlet and the outlet oriented relative to the major axis of the feeder body such that they each bear a tangential relationship to the path of rotation of the blades affixed to the rotor shaft. The blades function to effect a mixing of the wet material entering the feeder through the inlet formed therein as well as to accomplish a disintegration of any agglomerates present in the wet material. Finally, through blade action the wet material is discharged at high velocity from the outlet of the feeder. The feeder body is supported on a base, which is provided with adjustment means operative to effect adjustments in the angle of discharge of the wet material from the feeder relative to the center line of the conduit through which the hot gas stream flows. The angle of discharge of the wet material from the feeder is selected to be such that the wet material, upon leaving the feeder, enters the hot gas stream flowing through the conduit in substantially parallel relation thereto and coincident therewith so that maximum mixing of feed material and hot gases is attained whereby rapid flash drying of the wet material takes place.

DESCRIPTION OF A PREFERRED EMBODIMENT

Figure 1:
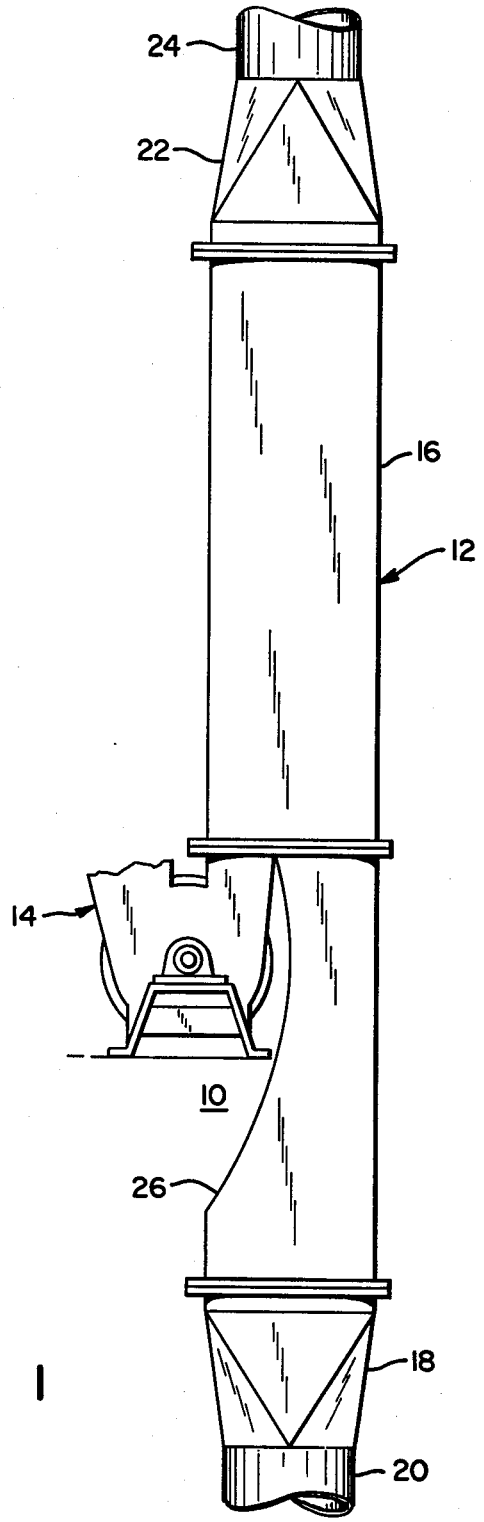
FIG. 1 is a side elevational view of a portion of a flash drying system, illustrating a Venturi dispersing feeder, constructed in accordance with the present invention, cooperatively associated with a conduit through which a hot gas stream flows.

Referring now to the drawing, and more particularly to FIG. 1, it is depicted therein a portion, generally designated therein by reference numeral 10 of a flash drying system. Specifically, there is shown in FIG. 1 a portion of a conduit 12, through which a hot gas stream flows in a manner yet to be described, and a Venturi dispersing feeder 14, constructed in accordance with the present invention, that is illustrated cooperatively associated with the conduit 12. Inasmuch as the present invention resides in the nature of the construction and the mode of operation of the feeder 14, and in the manner in which the feeder 14 is cooperatively associated with the conduit 12, it is not deemed essential for purposes of obtaining an understanding of the present invention to set forth herein a complete description or to depict in the drawing a complete illustration of the flash drying system of which the conduit 12 and the feeder 14 form a part. If further information is desired regarding the remaining portion of the flash drying system that are neither described nor illustrated in the instant application, reference may be had for this purpose to the prior art.

With further regard to the conduit 12, the latter, in accord with the best mode embodiment of the invention, embodies a rectangular configuration for at least a portion of the length thereof. Namely, as best understood with reference to FIG. 1 of the drawing, the conduit 12 includes a section 16 that has a rectangular configuration. At the upstream end of the section 16, the conduit 12 is provided with a first transitional portion, i.e., the portion 18, that has one end thereof suitably connected to the conduit section 16 and the other end thereof suitably connected to a portion 20 of the conduit 12 that is cylindrical in shape such that a fluid flow path exists from the cylindrical portion 20 through the transitional portion 18 to the conduit section 16. Similarly, at the downstream end of the section 16, the conduit 12 is provided with a second transitional portion, i.e, the portion 22, that has one end thereof suitably connected to the conduit section 16 and the other end thereof suitably connected to the cylindrical portion 24, such that a fluid flow path exists from the conduit section 16 through the transitional portion 22 to the cylindrical portion 24. Thus, it can be seen that there exists a through path for fluid to flow, and more specifically, for a hot gas stream to flow the length of the conduit 12, including the portion of the latter encompassed by the cylindrical portion 20, the transitional portion 18, the section 16, the transitional portion 22 and the cylindrical portion 24. Although the conduit 12 is depicted in FIG. 1 of the drawing as embodying a particular configuration, it is to be understood that modifications could be made in the configuration of the portion of the conduit 12 shown in FIG. 1, without departing from the essence of the present invention.

Continuing with the description of the nature of the construction of the conduit 12, the section 16 thereof, as best seen with reference to FIG. 1, has a portion thereof, identified in the drawing by the reference numeral 26, that is cut away. More specifically, the section 16 in accord with the best mode embodiment of the invention, is provided with a cut away portion 26, the primary function of which is to facilitate the cooperative association of the feeder 14 with the conduit 12, in a manner to which further reference will be had hereinafter. However, at this point it is deemed sufficient to merely note that the feeder 14 is mounted in juxtaposed relation to the conduit 12 such that the feeder 14 has a portion thereof, which is in fluid flow communication with the interior of the conduit 12.

Now turning to a discussion of the Venturi dispersing feeder 14 constructed in accordance with the present invention, reference will be had for this purpose particularly to FIGS. 2–5 of the drawing. As best seen with reference to FIGS. 4 and 5, the feeder 14 includes a body 28 that is operative as a housing for a rotor shaft 30. The feeder body 28 is, for the most part, largely cylindrical in shape. However, the feeder body 28 is provided with inlet means, in the form of an inlet opening 32 that is suitably constructed therein. The inlet opening 32 is connectable to a source of a wet feed, i.e., material to be dried, in a manner which will be described herein more fully subsequently. The wet feed is fed into the interior of the feeder body 28 through the inlet opening 32. In addition, the feeder body 28 has outlet means, in the form of a discharge outlet 34 formed therein. As will be explained more fully hereinafter, the discharge outlet 34 communicates fluidically with the section 16 of the conduit 12 and is operative to discharge wet feed therethrough into the interior of the conduit 12 whereupon the wet feed enters the hot gas stream flowing in the conduit 12. Apart from the inlet opening 32 and the discharge outlet 34 formed therein, the feeder body 28 comprises a substantially closed chamber. The only other openings (not shown) formed therein are those through which the ends of the rotor shaft 30 extend. The inlet opening 32 and the discharge opening 34, in accordance with the best mode embodiment of the invention, are suitably formed in the feeder body 28 so as to be oriented relative to the major axis of the feeder body 28 in such a manner that they each bear a tangential relationship to the path of rotation of the blades 36 that are mounted on the rotor shaft 30, in a manner yet to be described, so as to be rotatable therewith.

Figure 2:
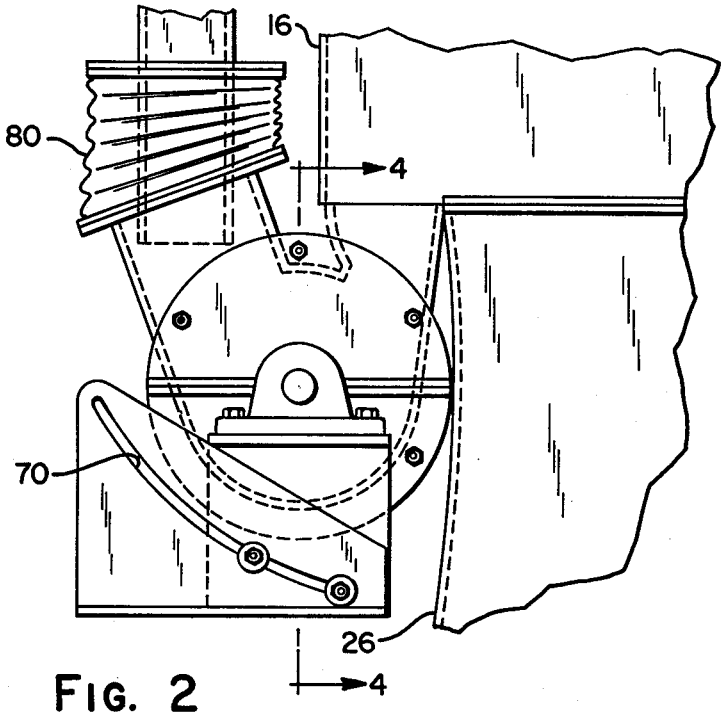
FIG. 2 is a side elevational view on an enlarged scale of a Venturi dispersing feeder, constructed in accordance with the present invention, illustrated with the angle of discharge therefrom being vertical.
Figure 4:
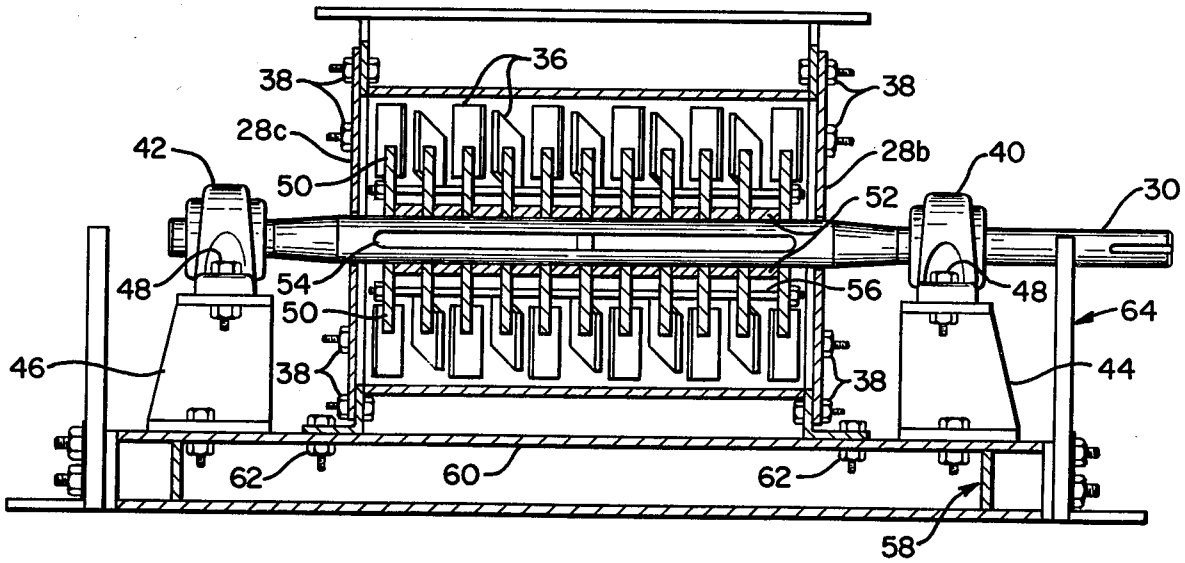
FIG. 4 is a cross sectional view of the Venturi dispersing feeder of FIG. 2, taken substantially along the line 4—4 of FIG. 2.

In accord with the illustrated embodiment thereof, the feeder body 28 is preferably of metal plate construction. Moreover, the feeder body 28 preferably is comprised of a main body portion 28*a* in which the inlet opening 32 and the discharge opening 34 are suitably located, and a pair of end plates 28*b* and 28*c* that are suitably secured such as through the use of conventional fastening means 38 to the main body portion 28*a*. As depicted in FIGS. 2 and 4 of the drawing, the fastening means 38 may take the form of conventional threaded fasteners that are received in threaded engagement within cooperating threaded nuts.

Continuing with the description of the feeder 14, the rotor shaft 30, to which reference has previously been had hereinbefore, is suitably supported relative to the feeder body 28 so as to be located substantially centrally thereof. To this end, the rotor shaft 30 lies along the major axis of the feeder body 28 and has its ends suitably supported externally of the feeder body 28 in a pair of suitable bearing means 40, 42. As best understood with reference to FIG. 4 of the drawing, the rotor shaft 30 in accord with the illustrated embodiment of the invention has one end thereof supported for rotation in the bearing means 40, which comprises a fixed pillow block of conventional construction, and the other end thereof supported for rotation in the bearing means 42, which comprises a floating pillow block of conventional construction.

In turn, the bearing means 40 and 42 are each suitably supported on a bearing bases 44 and 46, respectively. Each of the bearing bases 44 and 46 preferably includes a support member having a planar surface on which the bearing means 40 and 42, respectively, are positioned. Suitable fastening means 48 in the form of conventional threaded fasteners receivable in threaded engagement within cooperating threaded nuts are utilized for purposes of securing the bearing means 40 and 42 in place on the bearing bases 44 and 46, respectively.

Referring again to FIG. 4 of the drawing, as illustrated therein, the rotor shaft 30 has a multiplicity of spider members 50 suitably mounted thereon for rotation therewith. In accord with the best mode embodiment of the invention, each of the spider members 50 comprises a disk having an opening (not shown) at the center thereof for receiving therein the rotor shaft 30. Although as depicted in FIG. 4, the rotor shaft has a total of eleven such spider members 50 mounted thereon, it is to be understood that the rotor shaft 30 could be provided with a greater or a lesser number of spider member 50 without departing from the essence of the present invention. However, for a feeder body 28 defining an internal chamber therein of the relative size shown in FIG. 4 of the drawing, the desired number of spider members 50 to use therein has been found to be eleven.

The spider members 50 are mounted on the rotor shaft 30 in equally spaced relation one to another. Preferably, in order to maintain the desired spacing between adjoining spider members 50, a spacer member 52, in the form of a disc suitably received on the rotor shaft 30, is interposed between each pair of adjoining spider members 50. Any suitable form of conventional retaining means may be employed for purposes of retaining the spider members 50 and the spider members 52 on the rotor shaft 30. For example, the retaining means could take the form of a suitable key means 54 operative to effect the keying, in a manner well known to those skilled in the art, of the spider members 50 and/or the spacer members 52 to the rotor shaft 30. Finally, the spacer members 52 are preferably all tied together by means of a plurality of tie rods 56 suitably received in openings (not shown) provided for this purpose in each of the spider members 50. Preferably, as shown in FIG. 4 of the drawing, at least a pair of such tie rods 56 are employed, with the tie rods 56 being each located on opposite sides of the rotor shaft 30 and so as to extend substantially parallel to the rotor shaft 30.

As depicted in FIG. 4, each of the spider members 50 has a plurality of blades 36 mounted thereon, in such a manner as to be rotatable therewith. In accord with the best mode embodiment of the invention, the blades 36 are each designed to be replaceable. To this end, the blades 36 are detachably secured to the outer periphery of the spider members 50 through the use of any suitable form of conventional securing means (not shown) commonly found employed for such a purpose by those skilled in the art. Preferably, the blades 36 are supported on the spider members 50 so as to be mounted at a 30° angle relative to the rotor shaft 30, and so that each succeeding blade 36 is mounted at a 150° angle relative to the rotor shaft 30. Such an arrangement of the blades 36 has been found to be particularly effective in occasioning the disintegration of agglomerates contained in the wet feed entering the feeder 14. However, it is to be understood that the blades 36 could be arranged in some other fashion without departing from the essence of the invention, or, for example, swing hammers or swing knives could be utilized.

In accord with the illustrated embodiment of the invention, the feeder body 28 is supported on a suitable feeder base, generally designated by reference numeral 58 in the drawing. As best understood with reference to FIG. 4, the feeder base 58 includes a planar surface 60 to which the feeder body 28 is fixedly attached through the use of any suitable form of conventional fastening means 62. The latter fastening means 62 may, as depicted in FIG. 4, consist of conventional threaded fasteners that are received in threaded engagement within cooperating threaded nuts. With further regard to the feeder base 58, the latter, more specifically, may comprise a platform-like structure of which the planar surface 60 comprises, as viewed with reference to FIG. 4, the uppermost surface thereof. It is to be understood, however, that the feeder base 58 could embody some other configuration other than the specific one illustrated in FIG. 4 of the drawing, without departing from the essence of the present invention.

Figure 3:
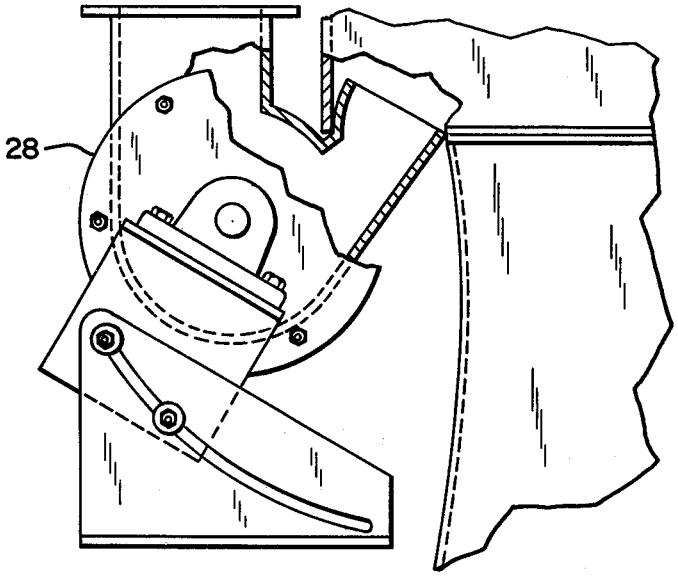
FIG. 3 is a side elevational view on an enlarged scale of a Venturi dispersing feeder, constructed in accordance with the present invention, illustrated with the angle of discharge from the feeder being 30° from the horizontal.

Completing the description of the nature of the construction of the Venturi dispersing feeder 14 of the present invention, the latter feeder 14 is provided with adjustment means, generally designated in the drawing by the reference numeral 64. The adjustment means 64 is operative to enable the angle at which wet feed is discharged from the outlet 34 of the feeder 14 to be adjusted relative to the center line of the conduit 12 so that, as will be more fully described hereinafter, the wet feed being discharged from the feeder 14 enters the hot gas stream flowing through the conduit 12 in substantially parallel relation thereto. In accord with the best mode embodiment of the invention, and as best understood with reference to FIGS. 2 and 3 of the drawing, the adjustment means 64 includes a pair of upstanding members 66 and 68, each of which has an arcuate slot 70 formed therein (only one of which is visible in the drawing). The slots 70 are suitably dimensioned so as to be capable of each receiving therein a pair of threaded members 72 and 74. The threaded members 72 and 74 are each fixedly attached at one end to a portion of the feeder base 58 so as to project outwardly therefrom substantially at right angles thereto. Moreover, the free ends of the threaded members 72 and 74 are receivable within the arcuate slots 70 such that at least a portion of each of the threaded members 72 and 74 protrude through the arcuate slots 70. Finally, cooperating threaded nuts 76 and 78 are receivable in threaded engagement on the threaded members 72 and 74, respectively. Accordingly, by tightening the nuts 76 and 78 on the threaded members 72 and 74, respectively, the latter threaded members 72 and 74 may be secured at any desired location within the arcuate slots 70. By virtue of the fact that the threaded members 72 and 74 are fixedly attached to the feeder base 58, the position of the threaded members 72 and 74 in the arcuate slots 70 establishes the degree to which the feeder base 58 is rotated about an axis defined by the axis of the rotor shaft 30 and therefore, the angle of discharge of wet feed from the feeder outlet 34 measured from a horizontal plane extending perpendicular from the longitudinal axis of the conduit 12. Namely, with the threaded members 72 and 74 positioned within the arcuate slots 70 as depicted in FIG. 2, i.e., at the lower end of the arcuate slots 70, the angle of discharge from the feeder outlet 34 is at a minimum, i.e., 0° measured from the aforereferenced horizontal plane. While, with the threaded members 72 and 74 positioned in the arcuate slots 70 as depicted in FIG. 3, i.e., at the upper end of the arcuate slots 70, the angle of discharge from the feeder outlet 34 is at a maximum, i.e., 30° measured from the aforereferenced horizontal plane. Further, it is to be understood, that as desired, the threaded members 72 and 74 could be positioned in the arcuate slots 70 at any point intermediate the positions thereof depicted in FIGS. 2 and 3 of the drawing, whereby the angle of discharge from the feeder outlet 34 would measure somewhere between 0° and 30° relative to the aforereferenced horizontal plane.

Changing the position of the discharge outlet 34 to effect a change in the angle of discharge of the wet feed therefrom, also produces a corresponding change in the position of the inlet opening 32 inasmuch as the discharge outlet 34 and the inlet opening 32 bear a fixed relationship one to another. Moreover, since the inlet opening 32 is connectable to a suitable conduit (not shown) through which wet feed is supplied from a source thereof to the feeder 14, preferably a compensating means 80 is interposed between the inlet opening 32 and the wet feed supply conduit (not shown) for purposes of compensating for changes in relative positions of the inlet opening 32 and the wet feed supply conduit (not shown), i.e., to insure that a closed flow path is provided from the wet feed supply conduit (not shown) to the inlet opening 32 for the wet feed. In accord with the best mode embodiment of the invention, the compensating means 80 comprises a flexible member that can be extended or retracted, as required, much as in the manner of a bellows to compensate for changes made in the angle of discharge of the wet feed from the discharge outlet 34 of the feeder 14. The flexible member 80 may have one end thereof fastened to the inlet opening 32 through the use of conventional fastening means (not shown) that are receivable in the openings 82 that are provided for this purpose in the flange portion 32*a*, which defines the mouth of the inlet opening 32. In a similar fashion, the other end of the flexible member 80 could be fastened to the discharge end of the wet feed supply conduit (not shown) through the use of any suitable form of conventional fastening means (not shown).

Figure 5:
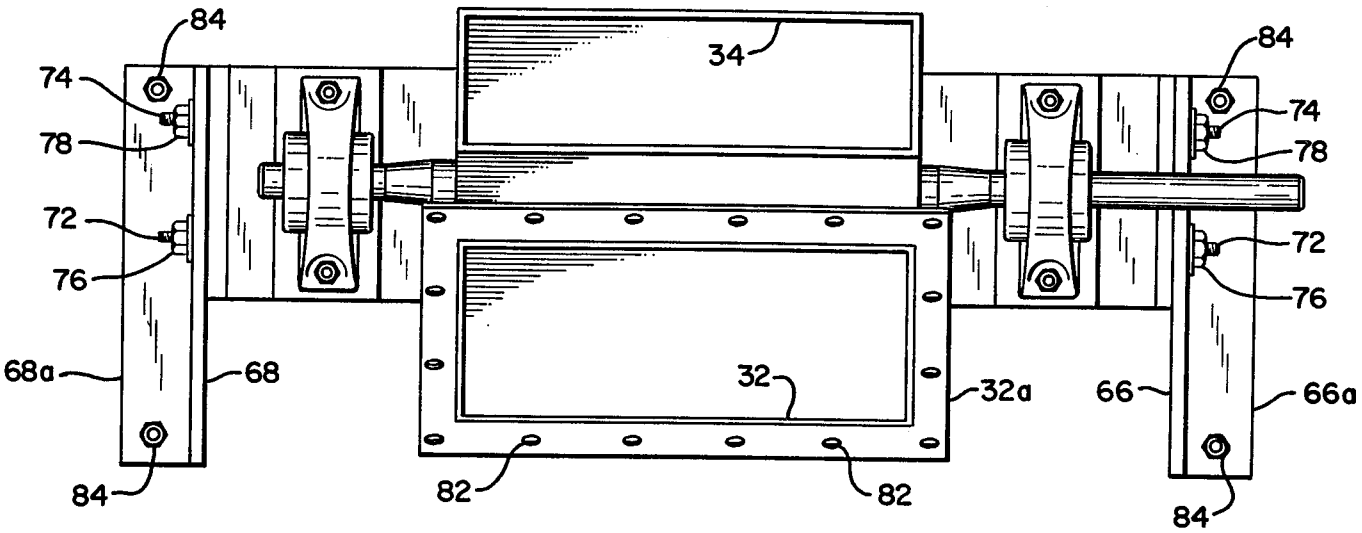
FIG. 5 is a top plan view on an enlarged scale of a Venturi dispersing feeder, constructed in accordance with the present invention.

Referring again to the upstanding members 66 and 68, the latter, as best seen with reference to FIG. 5, are preferably each provided with a portion 66*a* and 68*a*, respectively, formed integrally therewith and extending substantially at right angles thereto. The portions 66*a* and 68*a* are employed for purposes of fixedly mounting the Venturi dispersing feeder 14 to a suitable support surface (not shown). For this purpose, any suitable form of conventional fastening means 84, such as, for instance, conventional threaded fasteners and cooperating threaded nuts could be utilized to effect the aforereferenced mounting of the feeder 14 to the aforementioned suitable support surface (not shown).

The motive power required to effect the rotation of the rotor shaft 30 may be provided in any suitable manner, i.e., through the use of any suitable conventional form of motor drive (not shown). In accord with the best mode embodiment of the invention, the rotor shaft 30 preferably is driven from a conventional drive motor (not shown) that is coupled thereto by means of a conventional V-belt drive. Any movement in the relative position of the rotor shaft 30 occasioned by the need to effect changes in the angle of discharge of the discharge outlet 34 are easily accommodated with the aforedescribed V-belt drive. Namely, in such instances, the drive motor V-belt center to center distance only changes slightly, i.e., a distance, which is well within the adjustments provided for in a standard slide rail base for such a drive motor.

A description will now be had of the mode of operation of the Venturi dispersing feeder 14 when cooperatively associated with the conduit 12 as part of a flash drying system. For purposes of this discussion, it is assumed that the inlet opening 32 of the feeder 14 is connected in fluid flow relation by means of the flexible member 80 to the discharge end of a wet feed supply conduit (not shown), the other end of which is suitably connected in fluid flow relation to a source of suitable wet feed. By way of exemplification, the wet feed may be one selected from a wide range of materials including acid treated clay, feed mixtures, calcium carbonate sludge, sewage sludge, etc. In addition, the feeder 14 is suitably supported relative to the conduit 12, so as to be positioned in adjoining relation thereto, and with discharge outlet 34 positioned in fluid flow relation within the opening provided therefor in section 16 of the conduit 12. Namely, as best understood with reference to FIG. 1 of the drawing, the feeder 14 is located in the space produced by the cutting away of a portion of the section 16 of the conduit 12. As has been described previously hereinabove, by virtue of having cut away a portion of the conduit section 16, the portion 26 thereof remaining is of reduced cross sectional area as compared to those portions of the conduit 12 immediately upstream and immediately downstream of the portion 26. Accordingly, the hot gas stream flowing in the conduit 12 must become reduced in width in order to flow through the portion 26. The portion 26 thus is operative much in the manner of a Venturi. Namely, the velocity of the hot gas stream increases as the latter flows through the portion 26 of the conduit section 16. Moreover, concomitant with the increase in velocity, a corresponding pressure drop occurs in the portion 26.

With the feeder 14 positioned relative to the conduit 12 as described above and with the feeder inlet opening 32 suitably connected to the discharge end of a wet feed supply conduit (not shown), wet feed enters the feeder 14 through the inlet opening 32 thereof. As the wet feed enters the feeder body 28, it is engaged by the rotating blades 36 that are suitably mounted for rotation on a rotor shaft 30, the latter in turn being driven from a suitable drive motor (not shown). The rotating blades 36 are operative to effect the disintegration of any agglomerates that may be contained in the wet feed, as the latter enters the feeder body 28 through the inlet opening 32. In addition, the blades 36 are operative to effect the movement of the wet feed through the feeder body 28 from the inlet opening 32 thereof to the discharge outlet 34 thereof. After passing through the feeder body 28, the wet feed in a non-agglomerated form is discharged through the feeder discharge outlet 34 into the conduit 12. Upon entering the conduit 12, the wet feed is introduced into the hot gas stream flowing through the conduit 12 whereupon it mixes therewith, and in accordance with the performance of the flash drying process, the wet feed becomes dried by the hot gases almost instantaneously, i.e., within six to ten seconds. In order to effect the maximum mixing of the wet feed with the hot gases, it is important that the wet feed being discharged from the feeder discharge outlet 34 enter the hot gas stream flowing through the conduit 12 in substantially parallel relation thereto and coincident therewith. Namely, both for the purpose of insuring maximum mixing of the wet feed entering the hot gas stream and to minimize the likelihood that any of the wet feed being discharged from the discharge outlet 34 into the conduit 12 will impact against the side walls of the conduit 12 and will remain adhered thereto thereby giving rise to the possibility that the feed, which is adhered to the conduit side walls will subsequently become ignited from the heat of the hot gases and consequently cause a fire to start within the conduit 12, in accord with the present invention, it is important that the angle of discharge of the feeder discharge outlet 34 bears such a relationship to the center line of the conduit 12 that the wet feed being discharged through the outlet 34 enters the hot gas stream in the conduit 12 in substantially parallel relation thereto.

Thus, in accordance with the present invention there has been provided a new and improved dispersing feeder for discharging wet feed, i.e., material to be dried, into a hot gas stream. Moreover, the subject dispersing feeder of the present invention is particularly suited for use as one of the operating components in a flash drying system. In addition, in accord with the present invention, a dispersing feeder has been provided, which is operative to discharge the wet material therefrom in such a manner that the latter enters the hot gas stream substantially parallel thereto. Further, the dispersing feeder of the present invention embodies adjustment means operative to effect adjustments in the angle of discharge of the wet material therefrom to compensate for variations in material feed rates and/or gas flow rates. Additionally, in accordance with the present invention, a dispersing feeder is provided that embodies adjustment means operative to enable the angle of discharge of the wet material from the feeder to be set relative to the center line of the conduit through which the hot gas stream flows, whereby the point of entry of the wet material into the hot gas stream can be selected so that the wet material will not impact against the conduit side walls. Also, the dispersing feeder of the present invention is characterized in the fact that there is no flow of the hot gas stream therethrough. Furthermore, in accord with the present invention, a dispersing feeder is provided, which is particularly effective in accomplishing the disintegration of the agglomerates embodied in the wet material entering the feeder. Finally, the dispersing feeder of the present invention is relatively economical to manufacture, readily capable of being incorporated in flash drying systems, and is capable of providing effective and reliable operation.

While only one embodiment of my invention has been shown, it will be appreciated that modifications thereof, some of which have been alluded to hereinabove, may still be readily made thereto by those skilled in the art. I, therefore, intend by the appended claims to cover the modifications alluded to therein as well as all other modifications, which fall within the true spirit and scope of my invention.

What is claimed is:

1. In a system operative for effecting the drying of wet material by exposing the wet material to a stream of hot gases, the combination comprising:

a. conduit means having a stream of hot gases flowing therein, said conduit means having an opening formed therein providing access to the hot gas stream flowing through said conduit means; and b. a Venturi dispersing feeder including a feeder body having a chamber therein, inlet means provided in said feeder body communicating with said chamber, said inlet means being connectable in fluid flow relation with a source of wet material for receiving wet material therefrom, outlet means provided in said feeder body communicating with said chamber, said outlet means being cooperatively associated with said opening in said conduit means for discharging wet material into the path of the hot gas stream flowing into said conduit means, rotor means supported for rotation within said chamber in said feeder body, blade means mounted for rotation on said rotor means, said blade means being operative to effect the movement of the wet material through said chamber from said inlet means to said outlet means, and adjustment means cooperatively associated with said feeder body for adjusting the angle of discharge of the wet material from said outlet means through said opening into said conduit means and thereby relative to the path of flow of the hot gas stream in said conduit means.

2. In a system as set forth in claim 1 wherein said inlet means is located in said feeder body so as to bear a tangential relationship to the path of rotation of said blade means.

3. In a system as set forth in claim 1 wherein said outlet means is located in said feeder body so as to bear a tangential relationship to the path of rotation of said blade means.

4. In a system as set forth in claim 1 wherein said blade means comprises a multiplicity of blades, each of said multiplicity of blades being detachably mounted on said rotor means for ease of replacement, each of said multiplicity of blades being oriented relative to said rotor means to effect the efficient disintegration of agglomerates contained in wet material entering the chamber in said feeder body through said inlet means.

5. In a system as set forth in claim 1 wherein said rotor means includes a rotor shaft located centrally within said chamber in said feeder body, a plurality of spider members fixedly attached to said rotor shaft for rotation therewith, and spacer members supported on said rotor shaft in interposed relation between each two of said plurality of spider members.

6. In a system as set forth in claim 1 wherein said outlet means is operative to discharge the wet material into said conduit means so that the wet material enters the hot gas stream flowing in said conduit means in substantially parallel relation thereto and coincident therewith.

7. In a system as set forth in claim 1 wherein said adjustment means includes a pair of upstanding members, each of said pair of upstanding members having an arcuate slot formed therein.

8. In a system as set forth in claim 7 wherein said Venturi dispersing feeder further includes fastener means projecting outwardly from said feeder body, said fastener means being receivable in said arcuate slot formed in each of said pair of upstanding members, said fastener means being operative through the selective positioning of said fastener means at various locations in said arcuate slot formed in each of said pair of upstanding members to determine the establishment of the angle of discharge of the wet material from said outlet means through said opening into said conduit mean and thereby the angle of discharge of the wet material relative to the path of flow of the hot gas stream through said conduit means.

9. In a system as set forth in claim 1 wherein said conduit means, or at least a portion of the length thereof, embodies a rectangular cross section.

10. In a system as set forth in claim 9 wherein said portion of said conduit means embodying a rectangular cross section includes a section of reduced cross sectional area operative in the manner of a Venturi as the hot gas stream flows therethrough, said opening in said conduit means being located downstream of said section of reduced cross sectional area.

* * * * *